US007001214B2

(12) United States Patent
Fujii

(10) Patent No.: US 7,001,214 B2
(45) Date of Patent: Feb. 21, 2006

(54) CONNECTOR

(75) Inventor: Masayasu Fujii, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/070,754

(22) Filed: Mar. 2, 2005

(65) Prior Publication Data

US 2005/0196983 A1 Sep. 8, 2005

(30) Foreign Application Priority Data

Mar. 3, 2004 (JP) ..... 2004-059084

(51) Int. Cl.
*H01R 13/40* (2006.01)

(52) U.S. Cl. ..... 439/595

(58) Field of Classification Search ..... 439/595, 439/598

See application file for complete search history.

(56) References Cited

U.S. PATENT DOCUMENTS

| | | | | |
|---|---|---|---|---|
| 5,738,542 | A * | 4/1998 | Jakobeit et al. | 439/595 |
| 6,193,551 | B1 * | 2/2001 | Yamamoto et al. | 439/595 |
| 6,244,900 | B1 * | 6/2001 | Ishikawa et al. | 439/595 |
| 6,626,701 | B1 | 9/2003 | Yoshida et al. | |
| 6,811,437 | B1 * | 11/2004 | Nimura | 439/595 |
| 6,824,428 | B1 * | 11/2004 | Tabata et al. | 439/595 |
| 6,851,977 | B1 * | 2/2005 | Tsuji | 439/595 |

* cited by examiner

*Primary Examiner*—Tho D. Ta
(74) *Attorney, Agent, or Firm*—Gerald E. Hespos; Anthony J. Casella

(57) ABSTRACT

A connector has a housing (10) with a cavity (11) and a lock (12) that projects into the cavity (11). A defining wall (14) defines a deformation space (16) on a side of the lock (12) opposite the cavity (11). The lock (12) deflects into the deformation space (16) as a terminal fitting (40) is inserted into the cavity (11). The lock (12) then is restored resiliently to hold the terminal fitting (12) in the cavity (11). A support (18A, 18B, 18C) extends from the defining wall (14) and towards a space (17) between the lock (12) and a sidewall of the cavity (11) for supporting the terminal fitting (40) in the cavity (11).

11 Claims, 9 Drawing Sheets

CONNECTOR

BACKGROUND OF THE INVENTION

1. Field of the Invention

The invention relates to a connector with a lock for locking a terminal fitting.

2. Description of the Related Art

U.S. Pat. No. 6,626,701 discloses a connector with a housing that has a cavity for receiving a terminal fitting. A resilient lock is cantilevered along a bottom wall of the cavity and a deformation space is formed on a side of the lock opposite the cavity. The lock deforms into the deformation space in response to forces created as the terminal fitting is inserted into the cavity. The lock restores resiliently when the terminal fitting reaches a proper insertion position and locks the terminal fitting in the cavity.

The bottom wall of the cavity remains at both left and right sides of the lock to support the terminal fitting from below. These support sections of the bottom wall extend in from the inner sidewalls of the cavity and are supported only at one side.

FIG. 10 herein shows a lock 101 for locking a terminal fitting 102 in a cavity 103. The cavity 103 is defined partly by bottom wall sections 104 that extend a distance W in from the sidewalls towards the lock 101 for supporting the terminal fitting 102 from below. The cavity 103 and the terminal fitting 102 both are wider than the lock 101, and hence the width W of each bottom wall sections 104 is relatively large. The strength of each bottom wall section 104 is reduced as the width W is increased. Thus, the terminal fitting 102 may not be supported securely.

The present invention was developed in view of the above problem and an object thereof is to support securely a terminal fitting even if a cavity is wider than the lock.

SUMMARY OF THE INVENTION

The invention relates to a connector with a housing that has at least one cavity. A lock extends along a placing surface of the cavity to engage and lock a terminal fitting in the cavity. The housing has at least one defining wall for at least partly defining a deformation space for the lock. The defining wall is formed outwardly of the cavity and may extend substantially parallel with the placing surface of the cavity. A space extends substantially in a width direction between a sidewall of the cavity and the lock. At least one support is formed on the defining wall and aligns with the space. The support preferably stands up to approximately the same height as the placing surface of the cavity and supports the terminal fitting along the wall of the cavity that has the lock. Thus, the terminal fitting is supported more securely than a case where the terminal fitting is supported only by walls that cantilever in from sidewalls of the cavity.

The defining wall preferably is formed outwardly of the cavity over the entire width of the cavity.

The front end of the support preferably is coupled to and supported by a front wall of the housing to resist deformation.

First and second supports are preferably are arranged substantially symmetrically at opposite lateral sides of the lock.

The support preferably extends from a position more forward than the front end of the lock to or near the rear end of the lock.

A clearance preferably is defined between the support and the side surface of the lock and has a minimum dimension necessary to permit deformation of the lock without interference between the lock and the support.

An inner surface of the support preferably is slightly lower than the placing surface of the cavity, and most preferably is lower by a distance corresponding to the thickness of a plate material of the terminal fitting.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
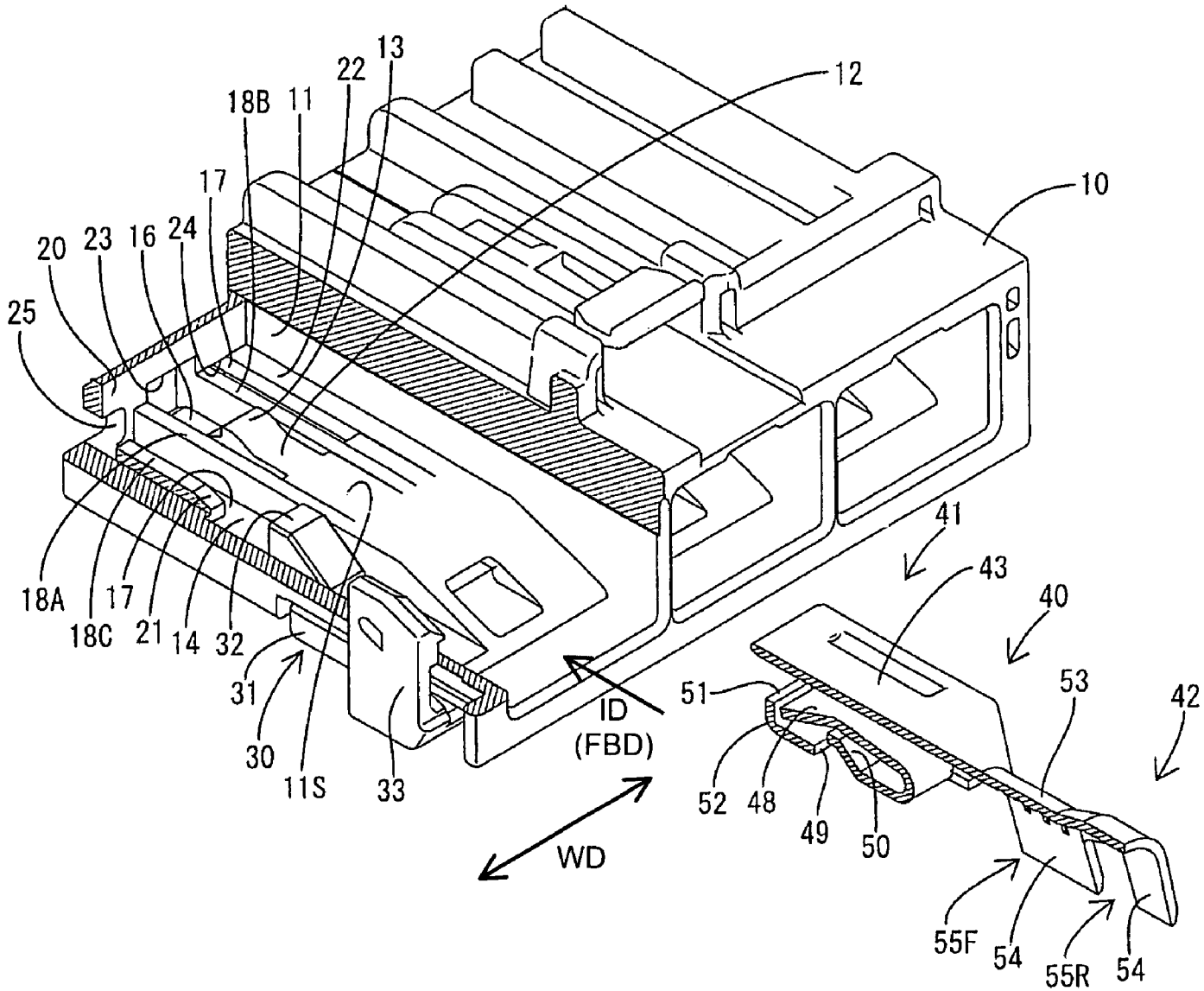
FIG. 1 is a perspective view partly in section of one embodiment of the invention.
Figure 2:
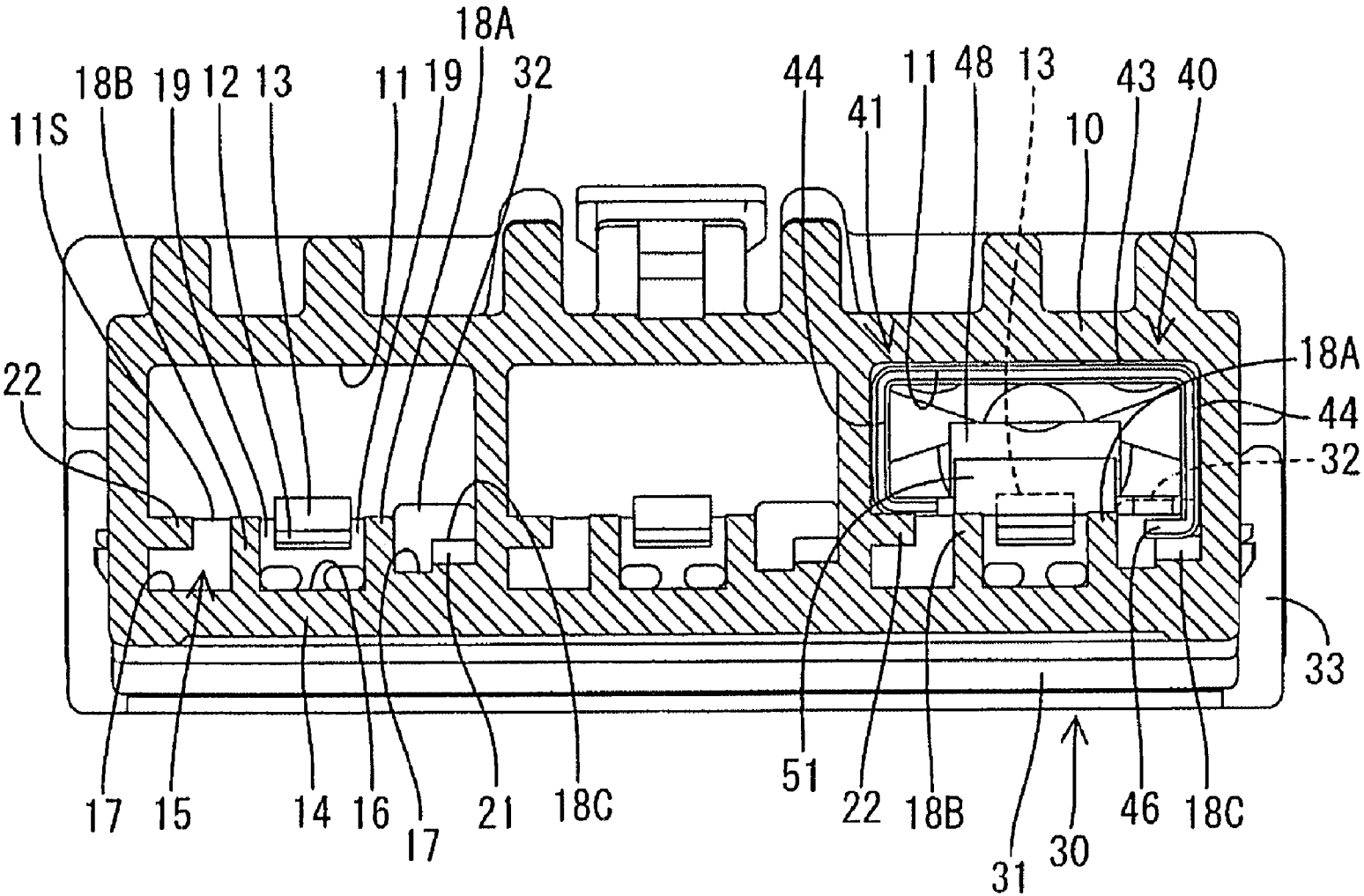
FIG. 2 is a lateral section of a housing.
Figure 3:
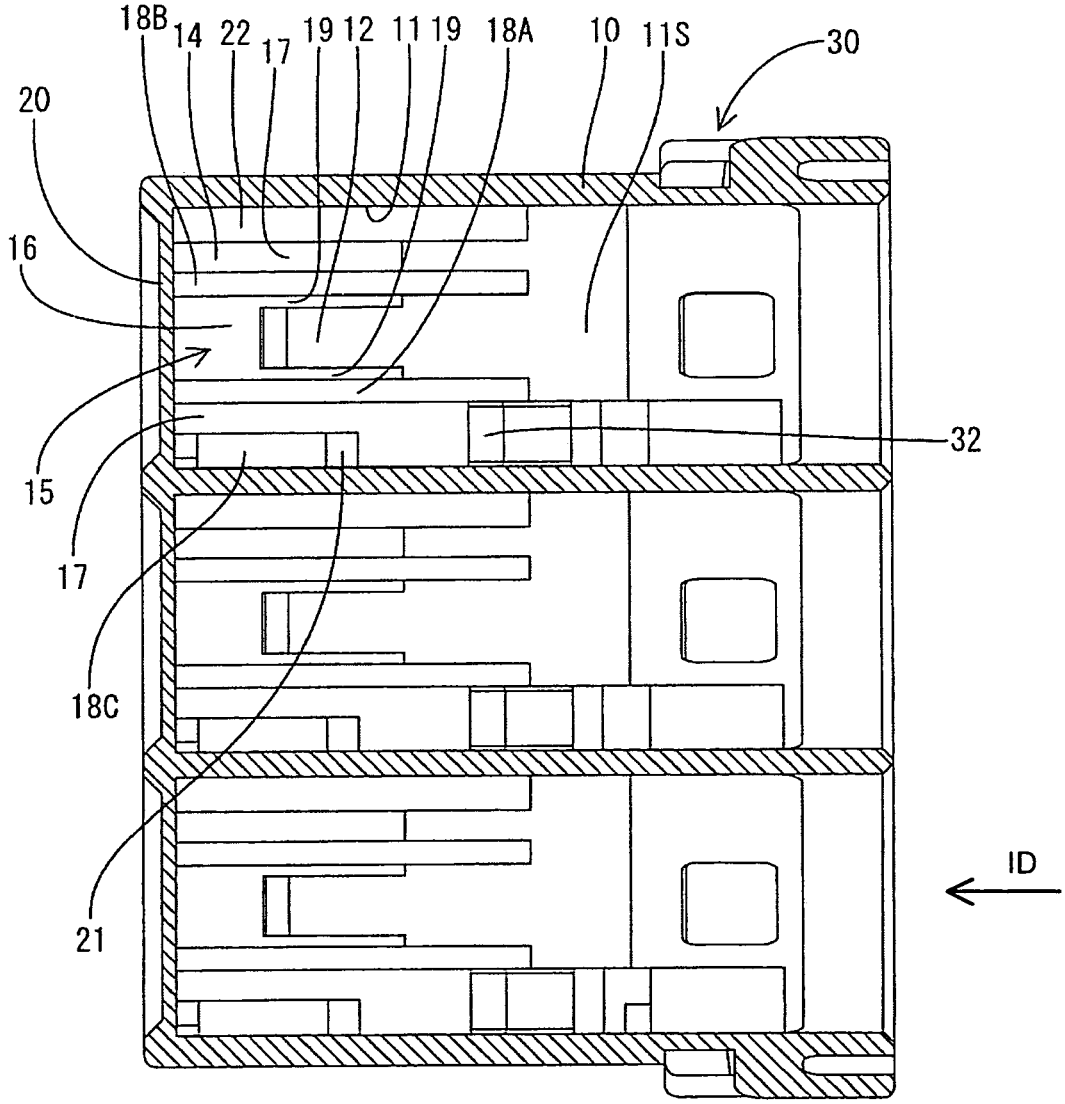
FIG. 3 is a horizontal section of the housing.
Figure 4:
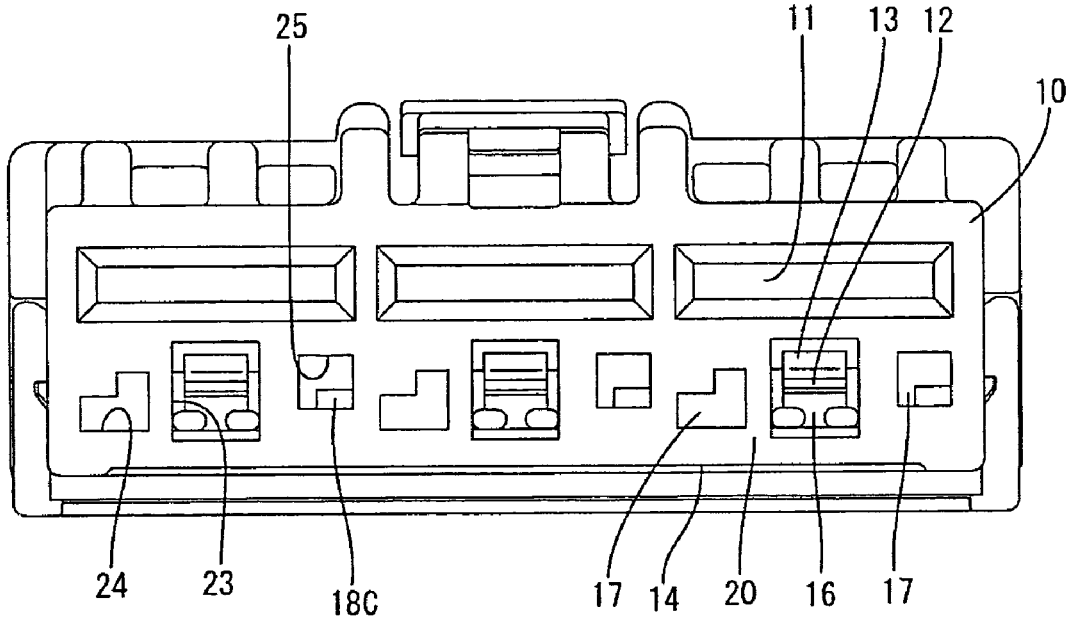
FIG. 4 is a front view of the housing.
Figure 5:
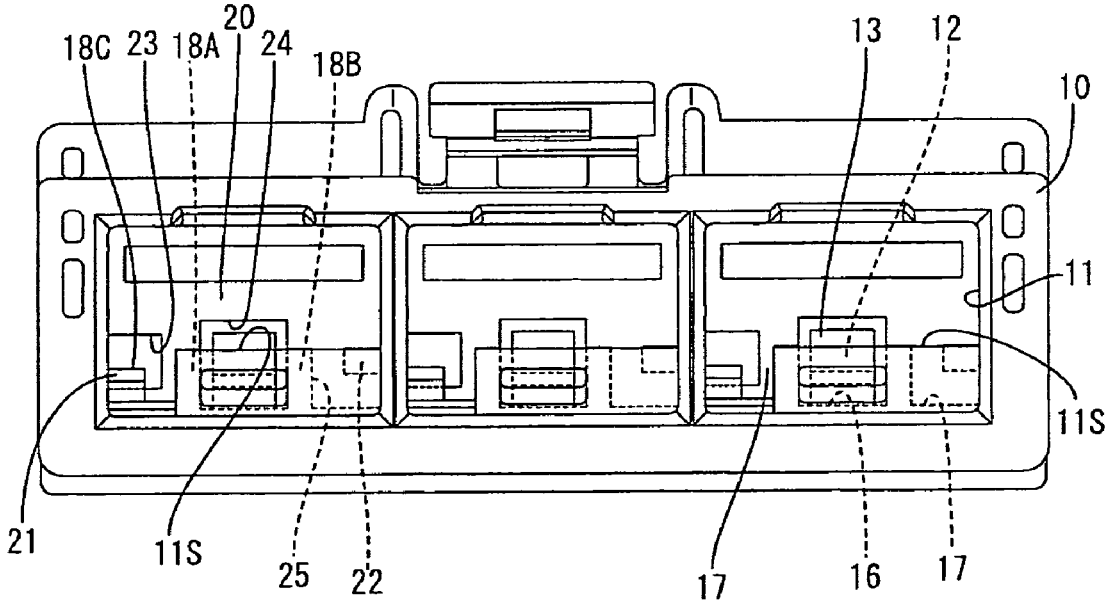
FIG. 5 is a rear view of the housing.
Figure 6:
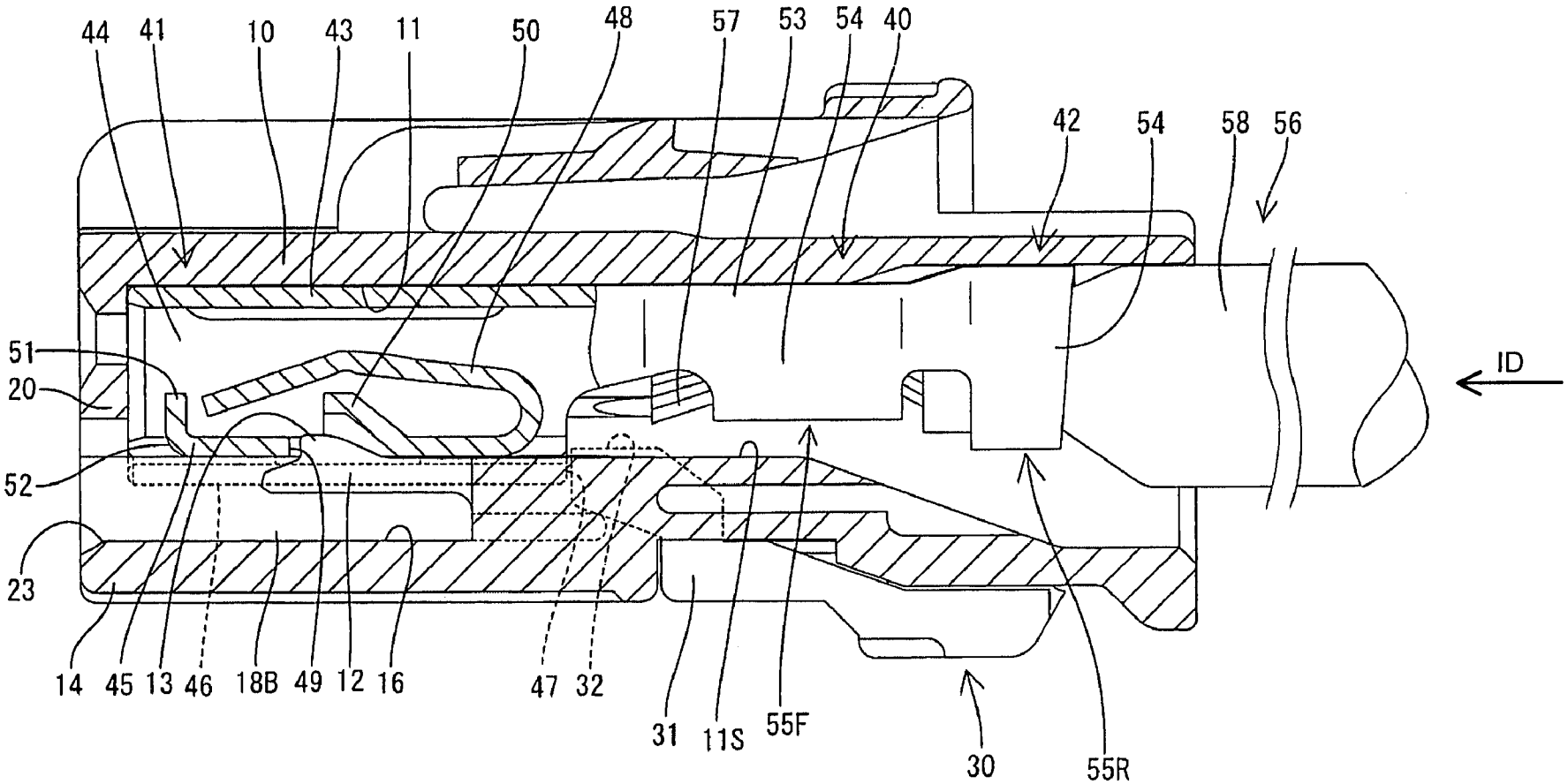
FIG. 6 is a longitudinal section of the housing.
Figure 7:
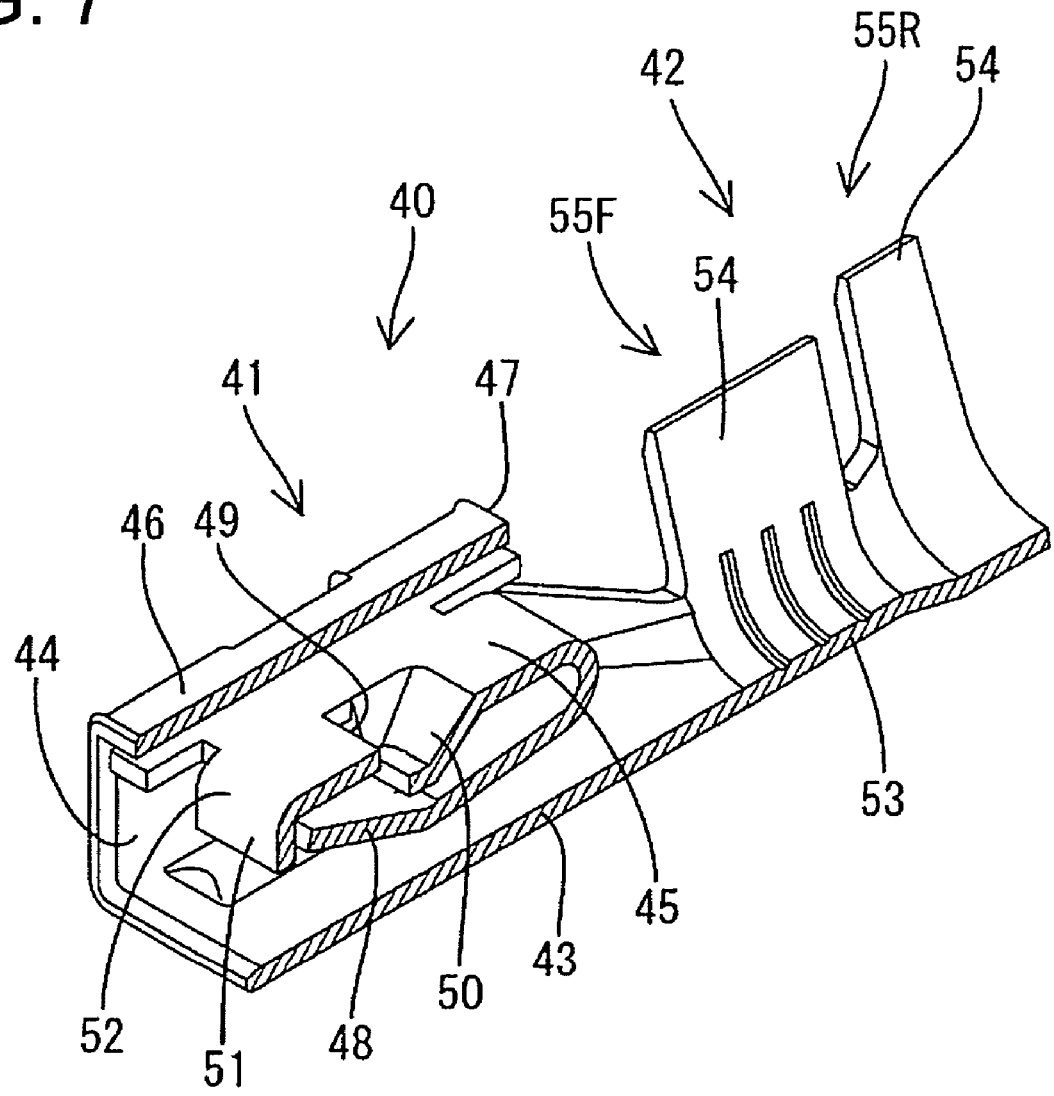
FIG. 7 is a perspective view partly in section of a terminal fitting.
Figure 8:
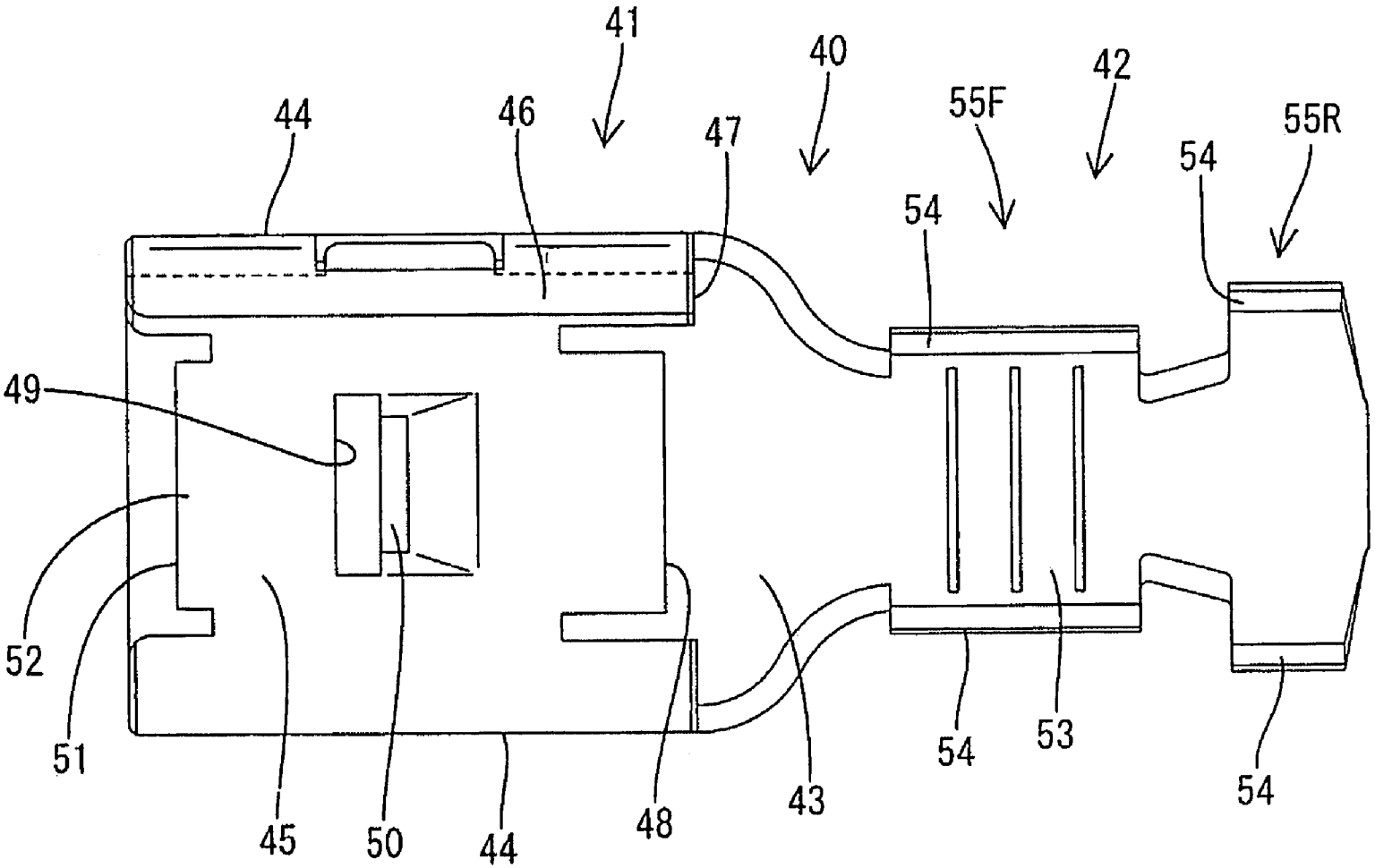
FIG. 8 is a plan view of the terminal fitting.
Figure 9:
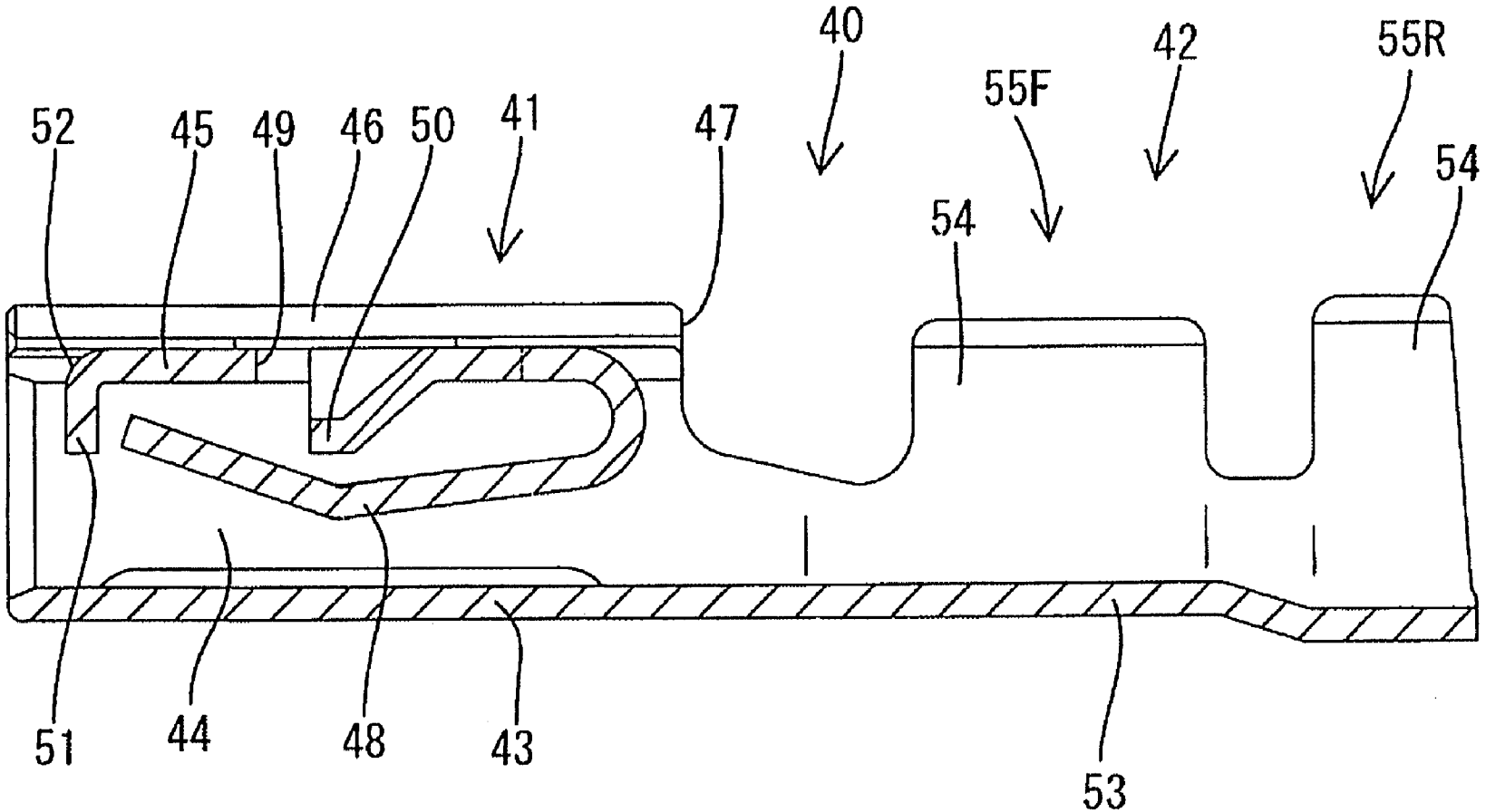
FIG. 9 is a longitudinal section of the terminal fitting.
Figure 10:
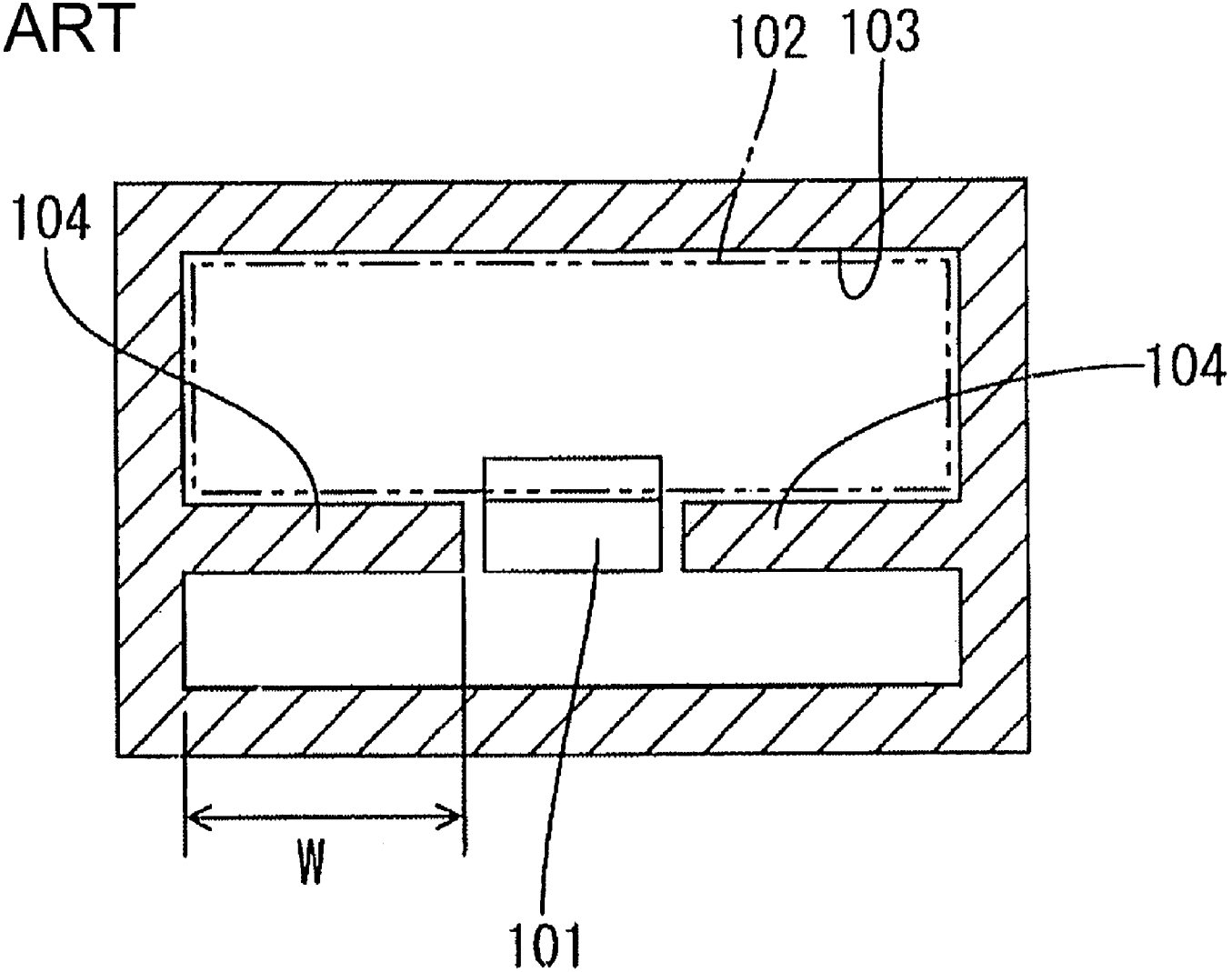
FIG. 10 PRIOR ART
FIG. 10 is a lateral section of a prior art housing.

A connector according to the invention is described with reference to FIGS. 1 to 9. In the following description, a mating side of the connector to be connected to a mating connector (not shown) is referred to as the front. Additionally, the terms top and bottom are used herein to provide a convenient frame of reference, but are not intended to imply a required gravitational orientation.

The connector has a rectangular block-shaped housing 10 made e.g. of a synthetic resin and three cavities 11 penetrate the housing 10 along forward and backward directions FBD. The cavities 11 are arranged side-by-side along a width direction WD. Each cavity 11 has a substantially rectangular lateral cross-section defining a width along the width direction WD that is larger than a height along a direction normal to the width direction WD.

A lock 12 is cantilevered forwardly in each cavity 11 and extends along a bottom surface 11S of the cavity 11. Each lock 12 is resiliently deformable up and down in a direction intersecting an inserting direction ID of a terminal fitting 40 into the cavity 11. Each lock 12 is at an intermediate position in the cavity 11 relative to the width direction WD. A retaining projection 13 projects up substantially normal to the inserting direction ID from a position on the upper surface of the lock 12 near the front end of the lock 12. In a free state where the lock 12 is not deformed, the upper surface of the lock 12 is at substantially the same height as the bottom surface 11S of the cavity 11 and the retaining projection 13 projects into the cavity. The lock 12 can be deformed resiliently down substantially normal to the inserting direction ID and out of the insertion path for the terminal fitting 40.

A defining wall 14 extends substantially parallel with the bottom surfaces 11S of the cavities 11 and defines an outer wall of the housing 10 below the cavities 11. Additionally, the defining wall extends substantially continuously over the entire width areas of the cavities 11. A wide lower space 15 is defined between the inner surface of the defining wall 14 and the bottom surface 11S of each cavity 11. The lower space 15 has substantially the same width as the cavity 11. A deformation space 16 is defined in a widthwise intermediate area of the lower space 15 directly below the lock 12 for permitting a downward deformation of the lock 12. Lateral spaces 17 are defined in the lower space 15 at the opposite left and right sides of the deformation space 16 between the lock 12 and the sidewalls of the cavity 11.

First to third supports 18A, 18B, 18C project from the inner surface of the defining wall 14 into the lateral spaces 17 and define ribs that are long and narrow along both the forward and backward directions FBD. The first and second supports 18A, 18B are arranged substantially symmetrically at the opposite lateral sides of the lock 12. Tiny clearances are defined between the transversely symmetrical supports 18A, 18B and the side surfaces of the lock 12. The clearances have the minimum dimensions to permit the lock 12 to deform without interfering with the supports 18A, 18B. The deformation space 16 is defined between the first and second supports 18A and 18B. The upper surfaces of the two supports 18A, 18B are slightly higher than the bottom surface 11S of the cavity 11. In other words, the two supports 18A, 18B project into the cavity 11 beyond the height of the bottom surface 11S of the cavity 11.

The front ends of the two supports 18A, 18B are coupled to a front wall 20 of the cavity 11 and the rear ends thereof are coupled to the bottom surface 11S of the cavity 11. Thus, the supports 18A, 18B extend along the forward and backward directions FBD from a position more forward than the front end of the lock 12 to the rear end of the lock 12.

The third support 18C stands up from the left end of the upper surface of the defining wall 14 and projects sideways from the left wall of the lower space 15 unitary to the respective left wall. The upper surface of the support 18C is slightly lower than the bottom surface 11S of the cavity 11 by a distance substantially corresponding to the thickness of a plate of the terminal fitting 40. The front end of the support 18C preferably is back from the front wall 20 of the cavity 11, and the rear end thereof is not coupled to the bottom surface 11S of the cavity 11. The support 18C extends along forward and backward directions FBD from a position more forward than the front end of the lock 12 to a position more forward than the rear end of the lock 12. A rear end of the upper surface of the support 18C is slanted to form an inclined surface 21 sloped upward or inward toward the front.

A bottom wall 22 extends in towards the lock 12 from the lateral wall of the cavity 11 and is supported only at one side. The upper surface of the bottom wall 22 is slightly higher than the bottom surface 11S of the cavity 11, and is at substantially the same height as the upper surfaces of the supports 18A, 18B. The extending end of the bottom wall 22 is at a side of the support 18B, which in turn is at a side of the lock 12. An extending distance of the bottom wall 22 from the side wall is only slightly larger than the thickness of the bottom wall 22. The front end of the bottom wall 22 is coupled to the front wall 20 of the cavity 11, and the rear end thereof is coupled to the bottom surface 11S of the cavity 11. The bottom wall 22 extends along forward and backward directions FBD from a position more forward than the front end of the lock 12 to the rear end of the lock 12. Thus, the bottom wall extends in substantially the same range of the supports 18A, 18B at the opposite sides of the lock 12.

Mold-removal holes 23, 24 and 25 penetrate the front wall 20 of the cavity 11. The mold-removal hole 23 corresponds to the lock 12 and the deformation space 16. The mold-removal hole 24 corresponds to the L-shaped space formed by the bottom wall 22 and the support 18B at the side of the lock 12. The mold-removal hole 25 corresponds to the support 18C at the lateral end and a space having an inverted L-shaped cross section extending along and the upper and right surfaces of the support 18C.

A retainer 30 is mounted to the housing 10 from below. The retainer 30 is made e.g. of a synthetic resin and includes a wide main portion 31. Three retaining projections 32 extend obliquely up towards the front from the upper surface of the main portion 31, and two protection walls 33 stand up from the opposite left and right edges of the main portion 31. The retaining projections 32 are at left end positions of the cavities 11 (insertion paths for the terminal fittings 40) when the retainer 30 is assembled partly with the housing 10. More particularly, the retaining projections 32 are behind the supports 18C at the leftmost positions and are at substantially the same positions as the supports 18C with respect to the width direction WD. A known locking means (not shown) with projections and/or claws is formed on side surfaces of the housing 10 and the holding walls 33 for holding the retainer 30 in its assembled state.

Each terminal fitting 40 is formed by bending a conductive metallic plate material stamped or cut out by a press. A substantially rectangular tube 41 is formed at a front portion and a wire-connecting portion 42 is formed at a rear portion. The tube 41 has a width in the width direction WD that exceeds the height and is hollow along forward and backward directions FBD. The rectangular tube 41 has a substantially flat base plate 43. Two side plates 44 extend at substantially right angles from the left and right edges of the base plate 43. A supporting plate 45 extends at a right angle from one side plate 44 in substantially parallel facing relationship to the base plate 43. The extending edge of the supporting plate 45 engages the extending edge of the other side plate 44. A bent edge 46 bulges at a substantially right angle from the extending end of the other side plate 44 and is placed on the outer surface of the supporting plate 45. The bent edge 46 projects from the outer surface of the supporting plate 45, and the rear end of the bent edge 46 defines a receiving portion 47 to contact the retaining projection 32 of the retainer 30.

A resilient contact piece 48 is bent from at an intermediate area of the rear edge of the supporting plate 45 into the rectangular tube 41 and extends forward to a free end. The resilient contact piece 48 is curved so that a longitudinal middle position defines a contact that is closest to the base plate 43. A mating male tab (not shown) inserted into the rectangular tube 41 from the front is squeezed resiliently between the contact of the resilient contact piece 48 and the base plate 43. Thus, a mating terminal and the terminal fitting 40 can be connected with a specified contact pressure.

The supporting plate 45 is formed with a substantially rectangular locking hole 49 at a widthwise intermediate position substantially corresponding to the contact of the resilient contact piece 48. The retaining projection 13 of the lock 12 is engageable with the front edge of this locking hole 49.

The supporting plate 45 is cut to form the locking hole 49 and this cut section is bent toward the resilient contact piece 48 to form an excessive deformation preventing portion 50. The resilient contact piece 48 contacts the excessive deformation preventing portion 50 while a degree of deformation of the resilient contact piece 48 still lies within a range of resiliency limit. As a result, an excessive deformation of the resilient contact piece 48 beyond the resiliency limit is prevented.

An area of the front end of the supporting plate 45 corresponding to the resilient contact piece 48 with respect to width direction WD is bent toward the base plate 43 to form a protecting portion 51. An arcuate surface 52 extends smoothly and continuous from the outer surface of the supporting plate 45 to the outer surface of the protecting portion 51. The rear surface of the protecting portion 51 faces the front edge of the resilient contact piece 48 while defining a small clearance. Thus, the front edge of the resilient contact piece 48 is hidden behind the protecting portion 51 over substantially the entire width to be protected from an interference of external matter.

The wire connecting portion 42 has a receiving plate 53 that is narrow and long along forward and backward directions FBD and extends backward from the rear end of the base plate 43 of the rectangular tube 41. Two front crimping pieces 54 and two rear crimping pieces 54 stand up from the opposite left and right edges of the receiving plate 53. A wire barrel 55F at a front position and an insulation barrel 55R at a rear position are formed by the receiving plate 53 and the crimping pieces 54. The wire barrel 55F is to be crimped, bent or folded into connection with an exposed core 57 of a wire 56, whereas the insulation barrel 55R is to be crimped, bent or folded into connection with an insulation coating 58 of the wire 56.

Each terminal fitting 40 is inserted in the inserting direction ID into the corresponding cavity 11 in a posture with the supporting plate 45 facing the lock 12. During the insertion process, the front edge of the supporting plate 45 of the rectangular tube 41 contacts the retaining projection 13 of the lock 12. As a result, the lock 12 deforms substantially normal to the inserting direction ID out of the insertion path for the terminal fitting 40 and into the deformation space 16. The retaining projection 13 slides in contact with the outer surface of the supporting plate 45. The arcuate surface 52 of the supporting plate 45 contacts the retaining projection 13 during the resilient deformation of the lock 12. Thus, the lock 12 is deformed smoothly without getting caught.

The lock 12 is restored resiliently when the terminal fitting 40 is inserted to a proper position. As a result, the retaining projection 13 enters the locking hole 49 and engages the front edge of the locking hole 49 from behind to achieve a partly locked state. The retainer 30 then is assembled with the housing 10 so that the retaining portion 32 engages the receiving portion 47 of the bent edge 46 of the rectangular tube 41 to achieve a fully locked state. In this way, the terminal fitting 40 is locked doubly by the lock 12 and the retainer 30 and will not come out.

The rectangular tube 41 of the terminal fitting 40 is inserted into the cavity 11 so that the outer surface of the supporting plate 45 contacts the upper surfaces of the supports 18A, 18B at opposite sides of the lock 12 and the outer surface of the bent edge 46 contacts the upper surface of the support 18C at the left side. The supports 18A, 18B, 18C projecting from the defining wall 14 support the terminal fitting 40 from below. The lateral edge of the supporting plate 45 opposite from the bent edge 46 contacts the upper surface of the bottom wall 22 at the right end, and the terminal fitting 40 also is supported from below by the contact with the bottom wall 22.

The defining wall 14 of the deformation spaces 16 is formed below the cavities 11 and extends over substantially the entire width of the cavities 11 substantially parallel with the bottom surfaces 11S of the cavities 11. Additionally, the lateral spaces 17 extend in a width direction WD between the sidewalls of the cavities 11 and the locks 12. The supports 18A, 18B, 18C project from the defining wall 14 at locations aligned with the lateral spaces 17 and extend to substantially the same height as the bottom surfaces 11S of the cavities 11. In this way, the supports 18A, 18B, 18C support the terminal fittings 40 in the cavities 11. As a result, the terminal fittings 40 are supported more securely as compared to the prior art construction in which the terminal fittings are supported only by the bottom walls cantilevered in from the sidewalls of the cavities.

The front ends of the supports 18A, 18B are coupled to the front walls 20 of the cavities 11. Thus, the front end of the defining wall 14 is supported on the front walls 20, thereby preventing deformation of the defining wall 14.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention is also applicable to male terminal fittings having tabs.

In the foregoing embodiment, the supports may be arranged only at one of the left and right sides of the locks.

In the foregoing embodiment, the number of the supports is two or smaller or four or larger.

The invention is applicable to connectors having no retainer.

The lock may be displaced laterally towards left or right in the foregoing embodiment.

The bottom wall may be left at both left and right sides in the foregoing embodiment. In such a case, the extending distances from the sidewalls at both left and right sides may differ.

The upper surfaces of the supports need not be continuous with the upper surface of the bottom wall behind the lock.

The supports need not be continuous along forward and backward directions, but may be arranged discontinuously along forward and backward directions FBD.

What is claimed is:

1. A connector, comprising:

a housing formed with at least one cavity and a lock extending along a placing surface of the cavity to engage and lock a terminal fitting inserted into the cavity;

at least one defining wall for defining a deformation space for the lock, the defining wall being formed unitarily with the housing and outwardly of the cavity;

a space extending in a width direction between a side wall of the cavity and the lock, and at least one support formed unitarily on the defining wall, the support being aligned with the space and extending at least towards a height position corresponding to the placing surface of the cavity.

2. The connector of claim 1, wherein the defining wall is formed outwardly of the cavity over the entire width area of the cavity.

3. The connector of claim 1, wherein the front end of the support is coupled to a front wall of the cavity.

4. The connector of claim 1, wherein the at least one support comprises first and second supports arranged substantially symmetrically at opposite lateral sides of the lock.

5. The connector of claim 1, wherein the support extends along forward and backward directions from a position more forward than a front end of the lock to a position near a rear end of the lock.

6. The connector of claim 1, wherein a clearance is defined between the support and a side surface the lock, the clearance defining a minimum dimension to permit resilient deformation of the lock without interference between the support and the lock.

7. The connector of claim 1, wherein an inner surface of the support is lower than the placing surface of the cavity by a distance substantially corresponding to a thickness of plate material forming the terminal fitting.

8. The housing of claim 1, wherein the support extends along forward and backward directions from a position more forward than a front end of the lock to a position near a rear end of the lock.

9. A connector housing with at least one cavity for receiving a terminal fitting, the housing being formed unitarily from a synthetic resin and comprising:

a defining wall spaced from the cavity so that a deformation space is defined between the defining wall and the cavity;

a resiliently deformable lock between the deformation space and the cavity and formed with a retaining projection that projects into the cavity, the lock being resiliently deformable towards the defining wall and into the deformation space in response to forces exerted during insertion of the terminal fitting into the cavity, the lock resiliently returning so that the retaining projection engages the terminal fitting that has been inserted substantially completely into the cavity; and at least one support projecting from the defining wall and disposed on at least one side of the lock for supporting the terminal fitting in proximity to the resiliently deformable lock.

10. The housing of claim 9, wherein the support has a front end coupled to a front wall of the cavity.

11. A connector housing with at least one cavity for receiving a terminal fitting, the housing comprising:

a defining wall spaced from the cavity so that a deformation space is defined between the defining wall and the cavity;

a resiliently deformable lock between the deformation space and the cavity and formed with a retaining projection that projects into the cavity, the lock being resiliently deformable towards the defining wall and into the deformation space in response to forces exerted during insertion of the terminal fitting into the cavity, the lock resiliently returning so that the retaining projetion engages the terminal fitting that has been inserted substantially completely into the cavity; and first and second supports projecting from the defining wall and arranged substantially symmetrically at opposite lateral sides of the lock for supporting the terminal fitting in proximity to the resiliently deformable lock.

* * * * *